United States Patent [19]

Smyth

[11] Patent Number: 4,570,934

[45] Date of Patent: Feb. 18, 1986

[54] POKER MACHINES

[75] Inventor: Richard E. Smyth, Sydney, Australia

[73] Assignee: Ainsworth Hominees Pty. Ltd., Australia

[21] Appl. No.: 673,608

[22] Filed: Nov. 21, 1984

[30] Foreign Application Priority Data

Dec. 23, 1983 [AU] Australia ..... PG2974

[51] Int. Cl.[4] ..... A63F 5/04

[52] U.S. Cl. ..... 273/143 R; 273/138 A

[58] Field of Search ..... 273/138 A, 143 R

[56] References Cited

U.S. PATENT DOCUMENTS 3,852,576 12/1974 Rudd ..... 273/138 A
4,037,845 7/1977 Hooker ..... 273/138 A
4,101,129 7/1978 Cox ..... 273/138 A
4,184,683 1/1980 Hooker ..... 273/143 R

*Primary Examiner*—Pinkham, Richard C.
*Assistant Examiner*—Vincent A. Mosconi

[57] ABSTRACT

A type of poker, slot or fruit machine of conventional construction but having on one or more of the drums or other symbol display elements a designated symbol. Whenever, the designated symbol appears on the pay line at the end of a play cycle the fact is recorded and one of a number of additional lights on the front of the machine is lighted. After a predetermined number of play cycles, preferably six or less, a prize is delivered depending on the number of times that the designated symbol has appeared on the pay line.

3 Claims, 6 Drawing Figures

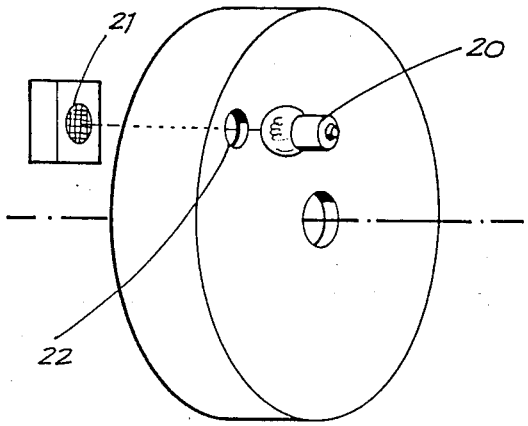
FIG. 5
FIG. 6
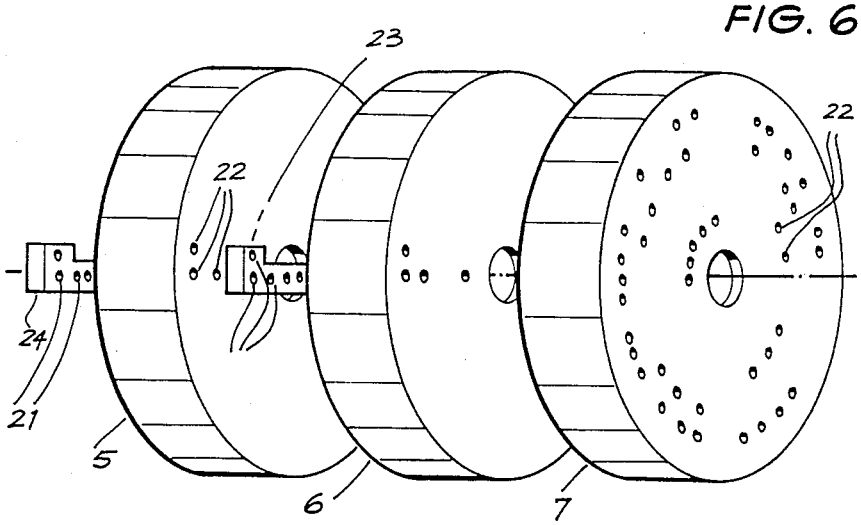

POKER MACHINES

The present invention relates to amusement machines of the kind known known variously as poker, slot or fruit machines. Such machines consist of a plurality of symbol display elements, usually drums of which there are commonly three, four or five, each drum having arranged around its periphery representations of a number of different symbols for example playing cards or pieces of fruit. The drums are arranged so that a line of symbols can be displayed behind a viewing window and are caused to rotate by pulling a handle or in some other manner to initiate a play cycle. At the end of a play cycle a combination of symbols is seen in the viewing window; predetermined combinations of symbols entitle the player to the benefit of a pay out which is either delivered directly in coins by the machine or indirectly through an attendant.

In order to maintain the enthusiasm of players for playing such machines it is necessary to present from time to time novel forms of prize and novel ways of winning a prize. In principle, the larger the prize offered and the more easily the prize is perceived by the player as being capable of being won, the more popular the machine is likely to be.

With this in mind various schemes have been proposed. For example, machines have been constructed to augment the amount paid out for a given combination of symbols each time the machine is taken through a play cycle. This is known as a "progressive" feature and where a number of machines are linked together this is known as a "link progressive" feature.

Other systems with the same objective have been proposed but, in common, with the "progressive" system they have the disadvantage that it can be a very long time before the indicated prize is paid out. In some case a period of many days. Experience has shown that while such systems can generate considerable interest towards the end, that is to say when a prize is about to be paid the interest produced in the earlier and middle stages is quite low.

The object of the present invention is to provide a system which enables a large prize to be offered which can be won or not as the case may be over a small predetermined number of game cycles for example six or less.

The present invention consists in a poker, slot or fruit machine having a plurality of symbol display elements each having a plurality of symbols, said machine being normally operative in a play cycle to display one symbol from each display element sequentially in a viewing area, said display elements being arranged to display in said viewing area at the end of a play cycle one symbol from each said display element to form a combination of said symbols which can have a predetermined score value, characterised in that at least one designated symbol is provided on at least one display element, there being means to detect the appearance of said designated symbol in the viewing area at the end of a play cycle and to give a visible indication of said designated symbol having been displayed, means to record and indicate the number of occurences of the display of said designated symbol after a predetermined number of play cycles and means to cancel the said visible indication before the next play cycle is commenced. Preferably the predetermined number of play cycles is small, for example six or fewer.

In order that the nature of the invention may be better understood a preferred form thereof is hereinafter described by way of example with reference to the accompanying drawings in which:

FIG. 5 shows diagramatically means for detecting the position of a drum and FIG. 6 shows a more elaborate arrangement for so doing.

Figure 1:
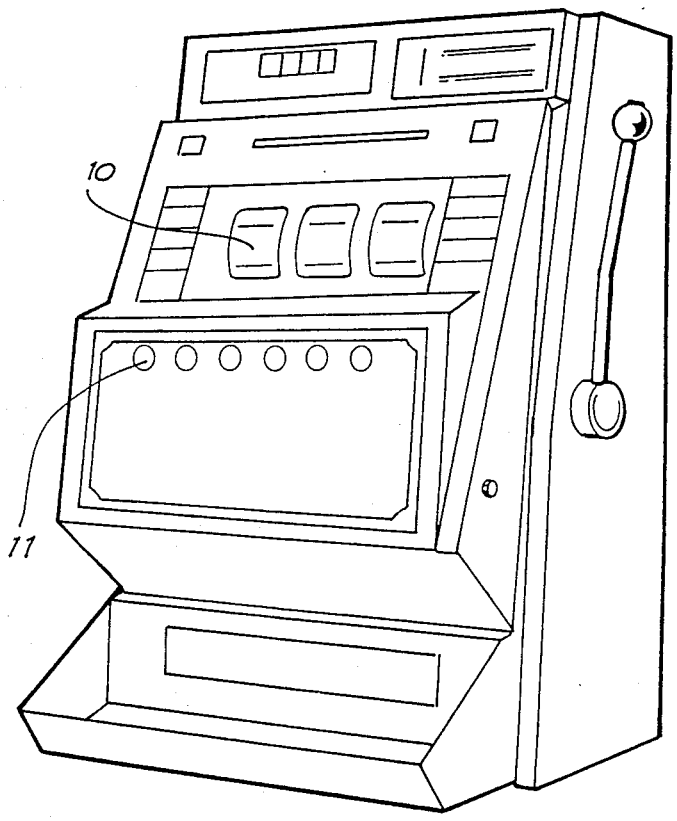
FIG. 1 shows a typical poker machine exterior with a viewing window.
Figure 2:
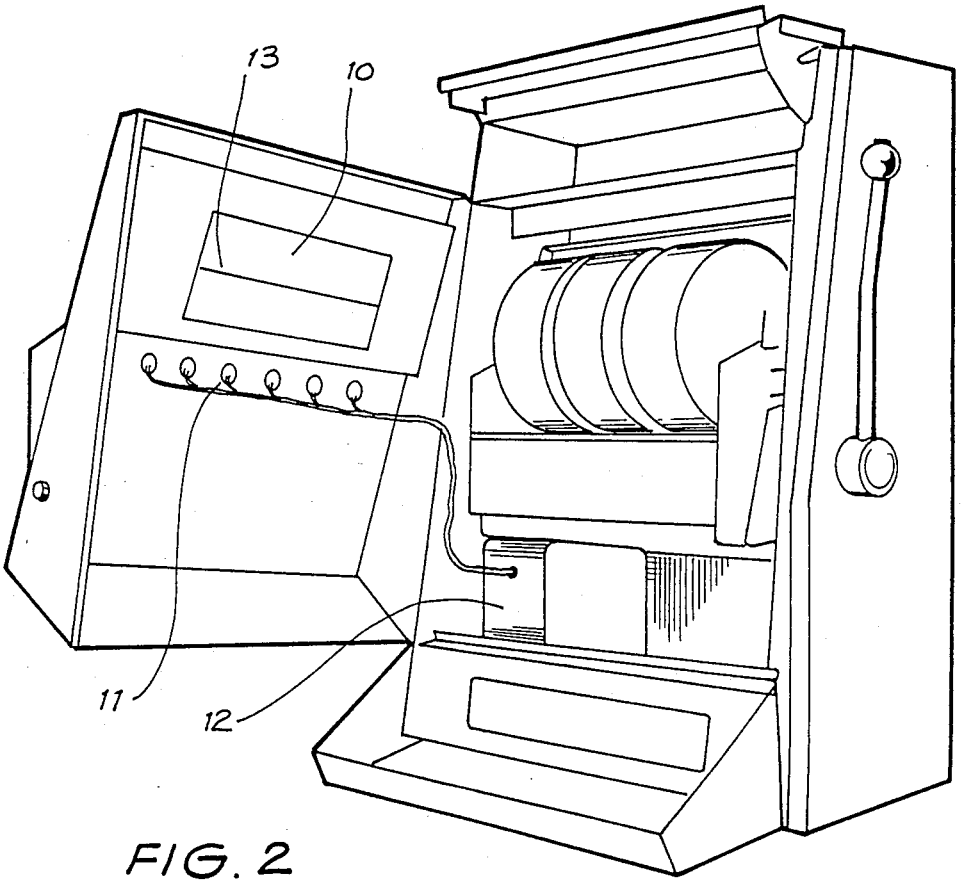
FIG. 2 shows the machine with the door open.

FIG. 1 shows a typical poker machine with the door closed, the machine in question being a three reel machine having a viewing area indicated at 10 having three separate openings one in respect of each reel. The general construction and method of operation of the machine are conventional. There are however arranged on the front of the machine a series of six indicator lights 11 which are connected, as shown in FIG. 2, to a microprocessor based controller 12.

The viewing area 10 has across it a "pay line" 13 and, whether or not a prize is delivered by the machine, is decided by the symbols that lie along the line 13 at the end of a play cycle.

Figure 3:
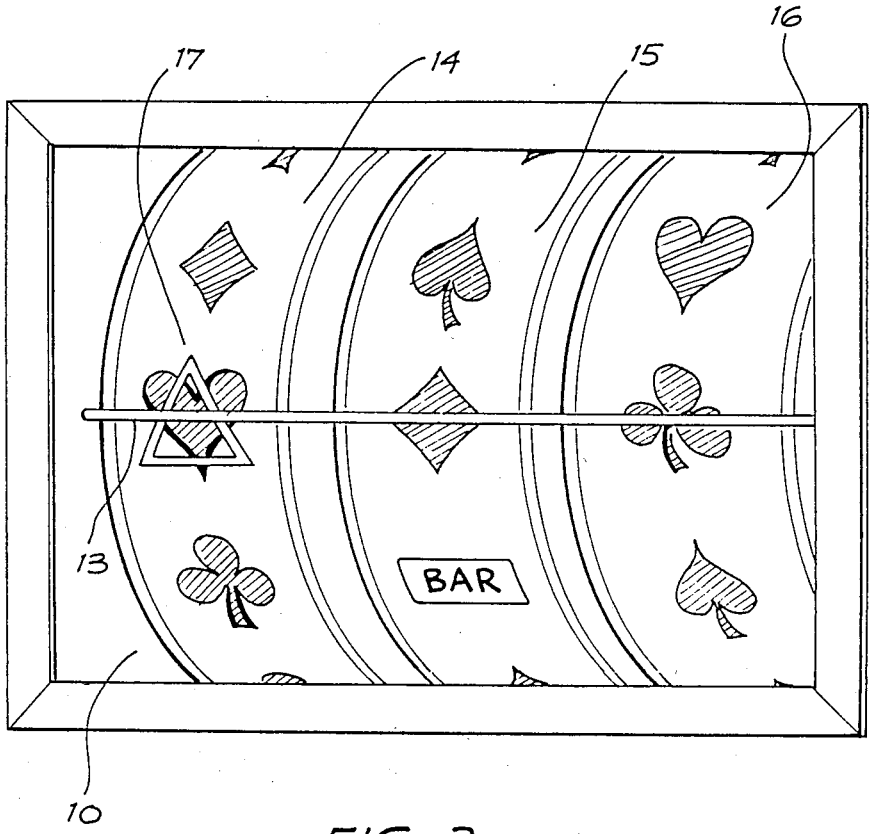
FIG. 3 shows three reels as viewed by the player through the viewing window.

FIG. 3 shows to an enlarged scale the play window 10 as seen by the player. The three reels 14, 15 and 16 have on them the usual symbols, in this case representations of heart clubs, spades, diamonds and others. However, on the reel 14 an additional symbol is included consisting of the representation of a triangle indicated at 17.

In this construction the additional symbol 17 is the designated symbol. It is, however, not necessary to use an additional symbol, as one of the usual symbols may be chosen as the designated symbol. Furthermore the designated symbol may be changed from play cycle to play cycle. It could be arranged for example that the largest prize was delivered as a result of a particular sequence of symbols being obtained in a series of successive play cycles.

A means for detecting the positions of the reels is depicted in FIGS. 5 and 6. FIG. 5 shows a simplified representation of the detection system in which a light source 20 is positioned on one side of a reel and directed toward a light detector 21 in such a manner that when the hole is positioned between the source and detector light passes through the hole 22 to reach the detector and when the hole is not so positioned, light does not reach the detector.

By using a number of detectors of the type shown in FIG. 5 it is possible to determine in which one of a number of available positions a reel currently rests. FIG. 6 depicts such an arrangement of sensors, wherein a lamp bracket 23 holds five light sources 20—typically infrared light emitting diodes—and a sensor bracket 24 holds five corresponding light detectors 21—typically phototransistors or photodiodes. The reel 5 positioned between the lamp bracket and the sensor bracket has a plurality of holes 22 arranged such that the detectors 21 produce a unique binary code for each rest position of the reel. The positoning of the holes 22 may best be seen on reel 7 which is depicted without the lamp and sensor brackets for clarity.

The output of the detecting means is fed to the microprocessor based controller 12 which is programmed so that each time the additional symbol 17 is detected as lying on the "pay line" 13 one of the lights 11 will be illuminated. At the beginning of a play cycle of a series of six play cycles none of the lights 11 is illuminated. If during the first play cycle of the series the additional symbol 17 comes to rest on the line 13 the left one hand of the lights 11 as seen in FIG. 1 will be illuminated. Each time this happens during the next five play cycles of the series an additional light will be illuminated and at the end of the series the microprocessor based controller will calculate and indicate a prize based on the number of lights 11 that have been illuminated. The amount of the prize paid out will depend on the number of lights lit, with a very large prize being delivered if all six lights are illuminated. At the end of the series the microprocessor based controller extinguishes all the lights and a new series is commenced whether or not enough lights 11 have been illuminated to pay a prize.

Figure 4:
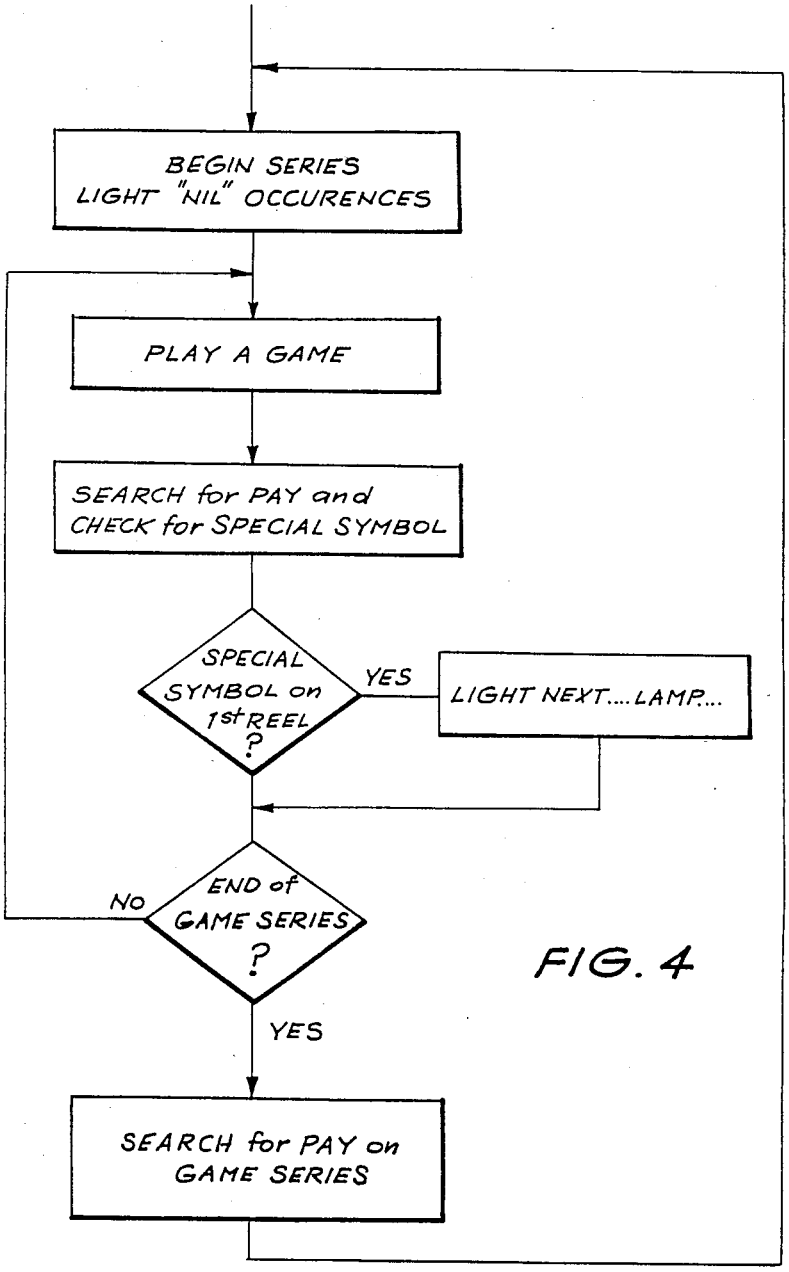
FIG. 4 shows a block diagram of events.

The block diagram shown in FIG. 4 illustrates the series of events during a series of play cycles as described above. The payment of a prize is effected in the usual manner either by delivering coins from the payout mechanism of the machine or by indicating the winning of a prize which is then paid by an attendant. The microprocessor controller is constructed on conventional lines and the devising of a suitable programme is a routine task for those skilled in the art.

The embodiment of the invention described above is given by way of example only as many variations within the general scope of the invention as defined by the succeeding claims may be introduced. For example, an additional light may be provided which will be illuminated at the beginning of a series to indicate that no occurences of the special symbol on the line 13 have occured. More than one special symbol on more than one of the reels may be provided. Symbol display elements other than reels may be used.

I claim:

1. A poker, slot or fruit machine having a plurality of symbol display elements each having a plurality of symbols, said machine being normally operative in a play cycle to display one symbol from each display element sequentially in a viewing area, said display elements being arranged to display in said viewing area at the end of a play cycle one symbol from each said display element to form a combination of said symbols which can have a predetermined score value, characterised in that at least one designated symbol is provided on at least one display element, there being means to detect the appearance of said designated symbol in the viewing area at the end of a play cycle and to give a visible indication of said designated symbol having been displayed, means to record and indicate the number of occurences of the display of said designated symbol after a predetermined number of play cycles and means to cancel the said visible indication before the next play cycle is commenced.

2. A poker, slot or fruit machine as claimed in claim 1 wherein the predetermined number of play cycles is more than one and less than six.

3. A poker, slot or fruit machine as claimed in claim 1 or claim 2 wherein the designated symbol is a symbol additional to said plurality of symbols.

* * * * *